US006963053B2

(12) United States Patent
Lutz

(10) Patent No.: US 6,963,053 B2
(45) Date of Patent: Nov. 8, 2005

(54) CORRUGATED METAL RIBBON HEATING ELEMENT

(75) Inventor: Timothy P. Lutz, Columbus, IN (US)

(73) Assignee: CCI Thermal Technologies, Inc., Edmonton (CA)

( * ) Notice: Subject to any disclaimer, the term of this patent is extended or adjusted under 35 U.S.C. 154(b) by 0 days.

(21) Appl. No.: 10/481,498

(22) PCT Filed: Jun. 25, 2002

(86) PCT No.: PCT/US02/20047

§ 371 (c)(1),
(2), (4) Date: Dec. 19, 2003

(87) PCT Pub. No.: WO03/007313

PCT Pub. Date: Jan. 23, 2003

(65) Prior Publication Data

US 2004/0173601 A1 Sep. 9, 2004

Related U.S. Application Data

(60) Provisional application No. 60/302,772, filed on Jul. 3, 2001.

(51) Int. Cl.[7] ..... H05B 3/40
(52) U.S. Cl. ..... 219/534; 219/544
(58) Field of Search ..... 219/534, 544, 219/552, 530, 238, 279, 316; 338/238, 279, 316; 29/611, 613

(56) References Cited

U.S. PATENT DOCUMENTS 854,834 A * 5/1907 Newell ..... 219/541

FOREIGN PATENT DOCUMENTS

WO WO 91/11892 * 8/1991

* cited by examiner

*Primary Examiner*—Robin O. Evans
*Assistant Examiner*—Vinod Patel
(74) *Attorney, Agent, or Firm*—Woodard, Emhardt, Moriarty, McNett & Henry LLP

(57) ABSTRACT

A sheathed electrical resistance heater is provided with a metal corrugated resistance heating element located internally within a surrounding metal sheath and separated from the sheath by a compacted insulating material such as magnesium oxide. The preferred corrugated resistance element is a flat strip of metal that has been corrugated such as by passing the strip through the nip of a pair of gears. The corrugated strip resistance element is thicker than a foil and may be used to provide sheathed, electrical resistance heaters where it is too difficult to wind large diameter wires, which are desired for a low resistance ohm of 0.12 ohm/inch or less, on a small arbor to form a coiled wire resistance element. A heater may be formed with a resistance of 0.05 ohm/inch using the corrugated metal ribbon and may be 200 inches in length and have a finned sheath. Preferably, the sheath is compressed in a die to reduce the cross-sectional area of the heater without a substantial elongation of the sheath.

6 Claims, 4 Drawing Sheets

CORRUGATED METAL RIBBON HEATING ELEMENT

This application is a provisional application of 60/302,772 filed Jul. 3, 2001

FIELD OF THE INVENTION

This invention relates to sheathed electrical resistance heaters having an outer metal sheath surrounding an internal resistance heating element and a compacted insulating material between the metal sheath and the internal resistance heating element, where the heater has a low resistance value.

BACKGROUND OF THE INVENTION

The conventional sheathed heating element uses a coiled wire as the resistance element that is able to elongate and contract as the electric element is turned on and turned off. The coiled wire is able to expand and contract in the manner of a coiled spring because of its coils without unduly stressing the resistance element itself or its connection with an electrical terminal which is usually a welded connection. The coiled resistance element accommodates different thermal—expansion coefficients of the different metals used for the sheath and for the heating resistance element. Typically, the sheath will be made of stainless steel, copper or aluminum while the resistance element will be an alloy having nickel, chrome or the like therein. Moreover, the external sheath and the internal resistance wire operate at different temperatures with the internal resistance element operating at a higher temperature than the outer sheath which is being cooled by the medium in which it is immersed whether the medium is air, a liquid, or other material. The resistance element operating at a higher temperature typically expands more than the outer protective sheath and hence the coil accommodates this difference in expansion between the sheath and the resistance element.

The conventional manner of making such coiled resistance elements comprises winding the resistance element wire on a mandrel and removing the wound wire coil from the mandrel; welding terminals to the ends of the wire coil and bringing the coiled wire and an external sheath tube together within a loading machine at which the insulating material is loaded between the internal coiled wire and outer sheath. Typically the insulating material is a granular or powdered material such as magnesium oxide. The filled tube is then extruded with the diameter of the sheath tube being reduced substantially and the length of the tube and internal coiled wire being increased greatly. The extruding pressures compact the insulating material greatly. When the coil wire is of fine gauge, it stretches easily during the extruding process, but as the wire diameter becomes large it becomes difficult to stretch the wire coils with conventional extruding pressures.

Also, as the diameter of the wire becomes larger, it is also more stiff and cannot be easily wrapped about a small diameter mandrel. For example, using conventional coiling equipment, wire diameters of 0.0285 inch are difficult to wind and wire diameters of 0.032 inch or larger are too stiff to be wound on the small diameter arbor selected for the size of coil desired. Given this limitation in size of the round wire diameters and using conventional resistance element wires, the largest wire that was able to be wound on the mandrel size needed for this application wire had a resistance of about 0.12 ohm/inch in the extruded, finished heating device. Some applications require a resistance lower than 0.12 ohm/inch. For example, in a very long heater, e.g., 200 inches or more which is to be operated at 120 or 240 volts, the resistance of the heating element in the final heater is desired to be about 0.05 ohm/inch which is substantially below the 0.12 ohm/inch of the largest coiled wires type of heating element for this mandrel diameter of heater assembly.

Heretofore, for these applications, requiring a lower ohm/inch heater than can be produced with coiled wire for the cross-sectional diameter of the heating element, a straight, uncoiled wire of larger diameter was used. This straight wire, sheathed heater is commonly referred to as mineral insulated or MI cable. A shorter length of wire is used in the MI cable. A significant shortcoming of this MI cable is that it does not accommodate thermal expansion of the heater very well and hence tends to stress the resistance element itself and also to stress the welded terminal joints, either of which can lead to a premature failure of the heater. Long life is an expected and necessary characteristic of sheathed, electrical resistance heaters and premature failures are unacceptable from a commercial marketing of the heater.

SUMMARY OF THE INVENTION

In accordance with the present invention, there, is provided a new and improved sheathed, electrical resistance heater having an internal corrugated ribbon heating element having a lower resistance value, e.g., 0.12 ohm/inch or less, than a round wire resistance element. Also, the percentage of the mass of the resistance heating element to the total mass of the resistance heater is less when using the corrugated ribbon than when using a round wire. The corrugations act as a spring to accommodate thermal expansion of the ribbon-shaped, heating element as well as contraction without placing undue stress on the ribbon itself or on terminal connections connecting the wire to terminals.

In accordance with a preferred embodiment of the invention illustrated and described hereinafter, the sheath of the heater is an aluminum tube with spaced, integral thin fins for conducting or radiating heat to the surrounding medium. A metal, corrugated ribbon, of resistance elements thicker than a thin foil (i.e. 0.003 inch to 0.010inch) is provided in the sheathed heater and has a resistance at least as low as 0.12 ohm/inch or lower. The insulating material is made of magnesium oxide or the like and it is compacted about the internal corrugated ribbon with a reduction in the cross-sectional area of the heater, but without the substantial increase length change of the conventional coiled wire heaters. The illustrated and preferred corrugated ribbon is formed by running a straight, flat wire strip through a nip of a pair of meshed gears. The present invention is not limited to this specific sheathed heater which is being described to provide one example or embodiment of the invention.

In accordance with the present invention, the corrugated ribbon, sheathed resistance heater is made by a process that comprises providing a corrugated ribbon heating element, placing the corrugated ribbon in an outer hollow sheath, filling the space between the corrugated ribbon and the outer sheath with an insulating material and pressing the filled sheath tube with sufficient pressure to compact the insulating material and to reduce or reshape the cross-sectional area of the filled sheathed tube without increasing substantially the length of sheath tube. In the preferred method, a sheath is provided with integral, spaced fins which are projecting outwardly and the pressing is done with a press formed to accommodate the projecting fins.

BRIEF DESCRIPTION OF THE DRAWINGS

FIG. 5A is an enlarged end view thereof, omitting the end mounting brackets shown in FIG. 5.

DETAILED DESCRIPTION OF THE PREFERRED EMBODIMENT

Figure 1:
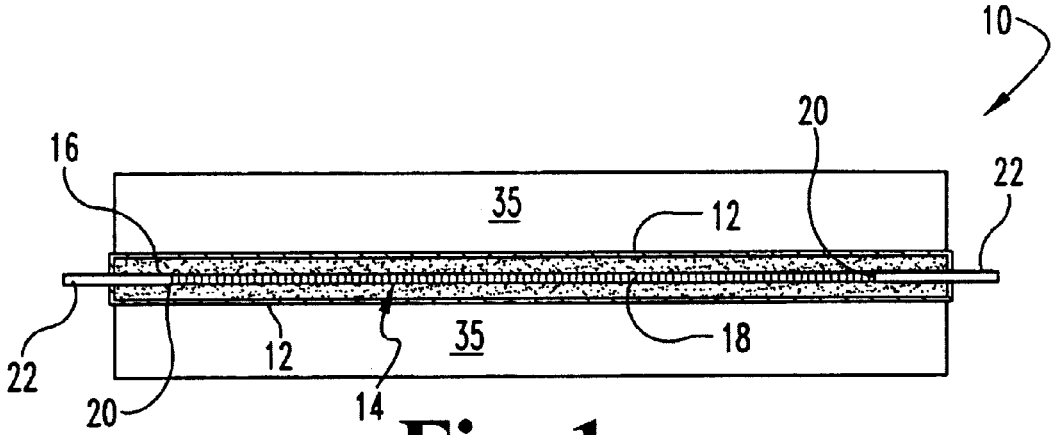
FIG. 1 is a plan cross-sectional view of a sheathed, electrical resistance heater having a corrugated heating element and constructed in accordance with the invention.
Figure 2:
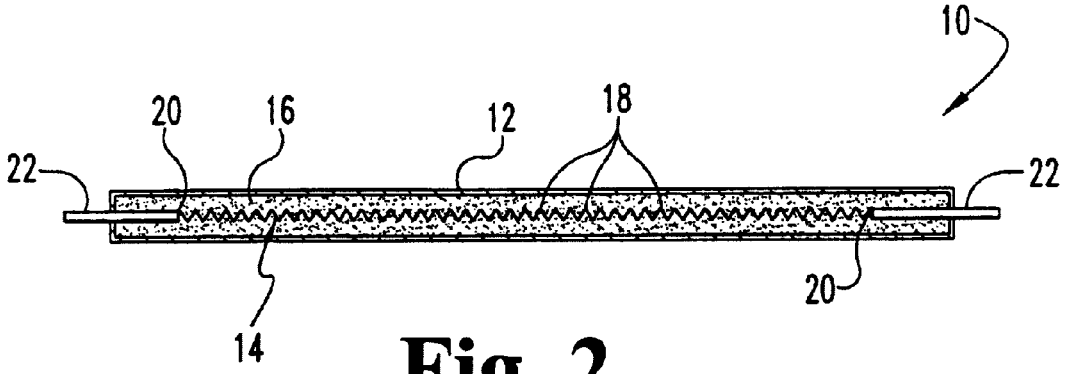
FIG. 2 is a side elevational view of the heater of FIG. 1.

As shown in the drawings, the invention is embodied in a sheathed, electrical resistance heater 10 having an outer sheath tube or sheath 12 made of metal such as steel or aluminum. Within the sheath 12 is an internal electrical resistance heating element 14 made of a conventional metal such as an alloy having nickel, chrome or the like therein. Between the sheath 12 and the electrical resistance heating element 14 is an insulating material 16 such as a compacted magnesium oxide powder.

Figure 5:
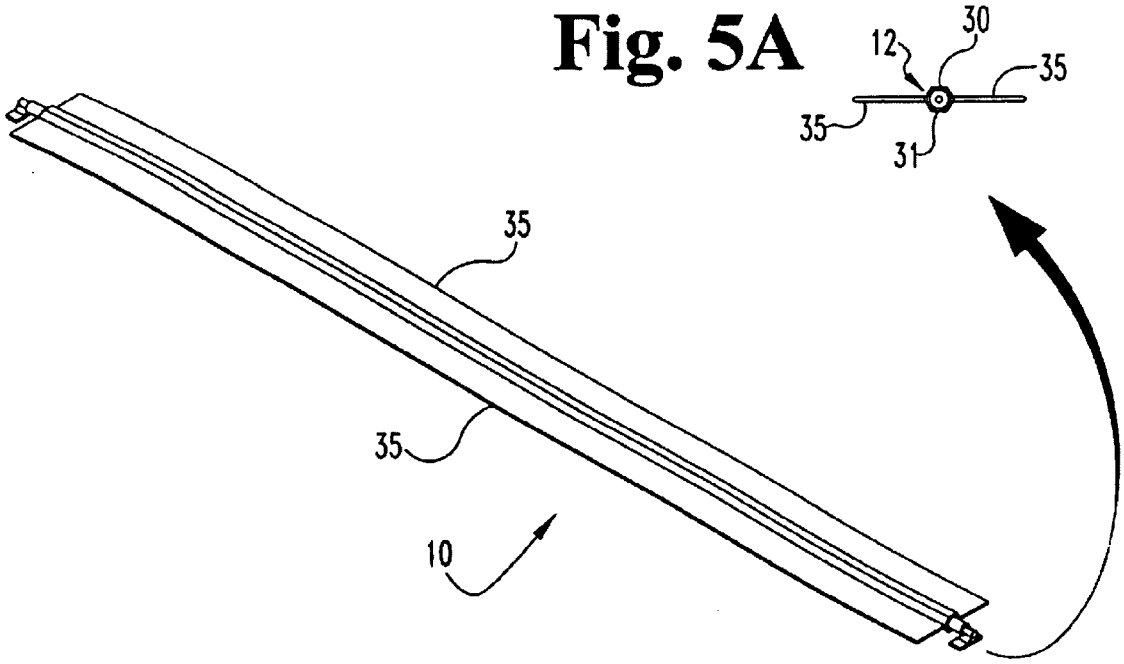
FIG. 5 is a perspective view of a finned, electrical resistance heater having a corrugated ribbon resistance element.

In some applications of the sheathed, electrical resistance heaters 10, the heater length desired may be quite long, e.g., 200 inches in length for the illustrated heater 10 shown in FIG. 5 with a very low resistance value of 0.05 ohm/inch when being operated at 120 or 240 volts. The cross-sectional area of the heater element may be quite small.

Figure 4:
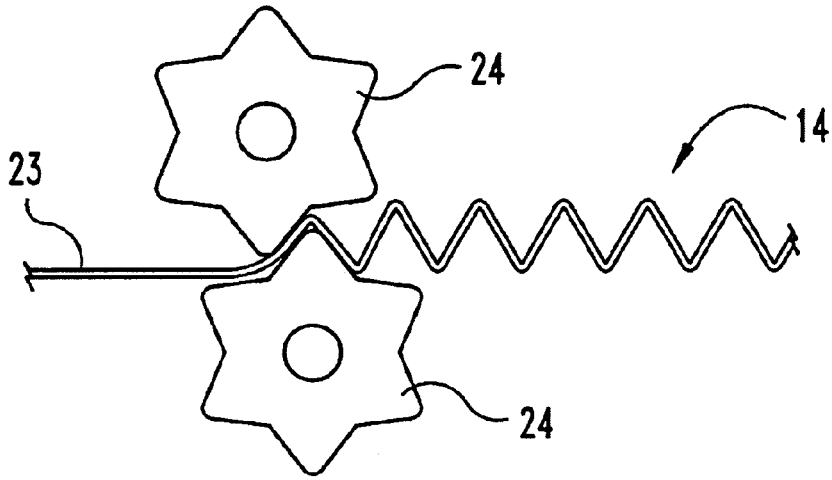
FIG. 4 illustrates a flat strip being corrugated by gears.

In accordance with the present invention, the sheathed electrical resistance beater 10 is provided with corrugations 18 in the electrical resistance element 14 to accommodate thermal expansion and contraction to avoid over stressing the element itself or its connections 20 to electrical terminals 22, which may be welded kind of connections between the terminals and the electrical resistance heater elements. Herein, the electrical resistance is an elongated ribbon having corrugations 18 extending substantially the entire length of the element and is preferably formed by passing a flat, metal strip 23 (FIG. 4) of metal into the nip of a pair of gears 24 that form the corrugations in the flat metal strip or ribbon that is thicker than a foil (from 0.003 inch to 0.010 inch). These resistance heaters usually operate at 120 to 240 volts. It will be appreciated that the corrugated ribbon has a relatively broader or larger surface than a circular cross-sectional wire and less mass and hence it heats faster to its operating temperature and cools down faster from its operating temperature than a comparable round wire.

Turning now in greater detail to the illustrated embodiment of the invention shown in FIG. 5, the outer sheath 12 is made of aluminum, in this instance, although it could be made of various other metals such as steel, copper or other alloys. Herein, the sheath tube is hexagonal in shape, although the sheath could be circular or have other shapes. In the illustrated heater of FIG. 5, the sheath was originally a round 0.375 inch tube that was pressed into a hexagonal shape that is about 0.345 inch across the flats 30, 31. The corrugated ribbon has a resistance of about 0.05 ohm/inch in the final heater 10. The illustrated heater has integral fins 35 that project outwardly from the sheath. The fins are spaced evenly. The illustrated heater 10 is about 200 inches long.

Figure 3:
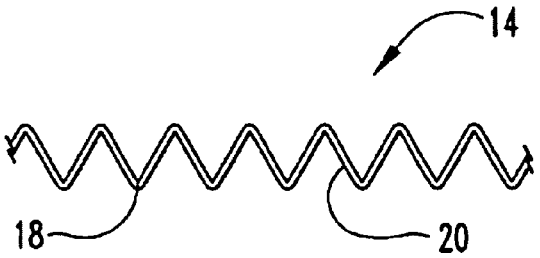
FIG. 3 is an enlarged view of the corrugation in the electrical resistance heating element constructed in accordance with the illustrated embodiment of the invention.

The illustrated heating element 14 is made from a flat ribbon of metal that is passed through the nip of gears 24 (FIG. 4) to form corrugations 18 (FIG. 3).

Figure 6:
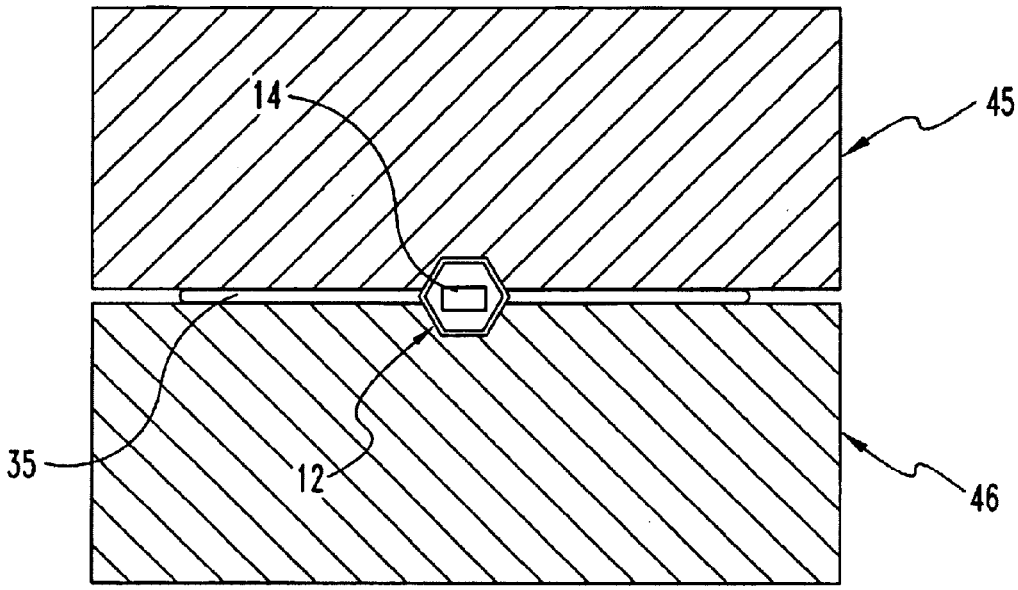
FIG. 6 is a cross-sectional view of the pressing die compacting the sheath around the filler and resistance element, not a corrugated ribbon.

The preferred embodiment of the invention shown in FIG. 5 is made by a method of corrugating the ribbon and placing it inside the tubular sheath and loading the magnesium oxide insulating material in a loading machine between the sheath 12 and the corrugated resistance element. A pair of dies 45 and 46 (FIG. 6) compress the sheath with sufficient pressure to reshape the tube from a circular shape into the hexagonal shape shown in FIG 5A. The fins 35 are integral and are accommodated in the press dies 45 and 46. Herein the sheath is compressed and reduced in cross-sectional area by about 20 percent without a substantial elongation of the tube. An example of a press for this embodiment is shown in FIG. 6.

The desired low resistance of about 0.05 ohm per inch mentioned above for a very long heater, would also be applicable in a case where it is desired to connect several shorter heaters in series, instead of a single long heater.

What is claimed is:

1. A sheathed electrical resistance heater having a low resistance value comprising:

an internal resistance heating element made of metal ribbon having a predetermined rate of expansion and for operating over a predetermined operating range of temperatures, having corrugations therein to accommodate thermal expansion of the heating element and to reduce stress on the heating element and joints, and having a resistance value of less than 0.12 ohms/inch;

a surrounding insulating material;

a surrounding tubular outer metal sheath having a different coefficient of expansion than the coefficient of expansion of the internal heating element;

the outer metal sheath having been pressed to compact the insulating material without substantial longitudinal extension of the sheath, the sheath having one or more integral longitudinal fins extending radially outwardly.

2. A sheathed electrical resistance heater in accordance with claim 1 wherein the corrugations extend substantially the entire length of the heating element.

3. A sheathed electrical resistance heater in accordance with claim 1 wherein the internal heating element is an elongated flat strip that has corrugations therein.

4. A sheathed electrical resistance heater in accordance with claim 1 wherein the heating element has a resistance of 0.05 ohm per inch or less.

5. A sheathed electrical resistance heater in accordance with claim 1 wherein the sheath is made substantially of aluminum and the internal corrugated conductor is made of a metal alloy that does not have aluminum as a substantial constituent therein.

6. A method of making a sheathed electrical resistance heater having an outer elongated sheath and an internal, metal resistance heating element separated from the sheath by an insulating material, the method comprising:

providing an elongated metal ribbon, electrical resistance heating element that is corrugated over substantially its entire length;

disposing the corrugated heating element and the outer sheath; and pressing the sheath with sufficient pressure to reduce substantially the cross-sectional area of the sheath thereby compacting the insulating material within the sheath without substantially elongating the length of the elongated sheath by providing integral fins projecting outwardly therefrom, wherein the heating element has a resistance value less than 0.12 ohms/inch.

* * * * *